US008360799B2

(12) United States Patent
Wu

(10) Patent No.: US 8,360,799 B2
(45) Date of Patent: Jan. 29, 2013

(54) ELECTRICAL CONNECTOR ASSEMBLY

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/206,511

(22) Filed: Aug. 10, 2011

(65) Prior Publication Data

US 2012/0040552 A1 Feb. 16, 2012

(30) Foreign Application Priority Data

Aug. 10, 2010 (CN) ..... 2010 1 0250011

(51) Int. Cl.
*H01R 13/627* (2006.01)

(52) U.S. Cl. ..... 439/358

(58) Field of Classification Search ..... 439/358, 439/352

See application file for complete search history.

(56) References Cited

U.S. PATENT DOCUMENTS 6,155,872 A * 12/2000 Wu ..... 439/541.5
6,203,379 B1 * 3/2001 Cai et al. ..... 439/676
6,238,244 B1 * 5/2001 Yang ..... 439/607.01
6,383,024 B1 * 5/2002 Wang et al. ..... 439/607.23
6,503,102 B1 * 1/2003 Zhang et al. ..... 439/607.55
6,524,130 B1 * 2/2003 Yeh ..... 439/541.5
6,524,135 B1 * 2/2003 Feldman et al. ..... 439/607.46
6,776,658 B2 * 8/2004 Tang ..... 439/607.58
6,786,755 B2 * 9/2004 Dambach et al. ..... 439/353
6,913,482 B1 * 7/2005 Wu ..... 439/502
7,114,980 B1 * 10/2006 Wu ..... 439/352
7,147,501 B1 * 12/2006 Wu ..... 439/352
7,147,502 B1 * 12/2006 Wu ..... 439/352
7,160,135 B1 * 1/2007 Wu ..... 439/352
7,226,316 B2 * 6/2007 Wu ..... 439/607.44
7,238,040 B1 * 7/2007 Wu ..... 439/352
7,261,582 B2 * 8/2007 Wu ..... 439/352
7,281,937 B2 10/2007 Reed et al.
7,354,292 B1 * 4/2008 Lloyd et al. ..... 439/352
7,364,465 B2 * 4/2008 Wu ..... 439/607.55
7,413,473 B2 * 8/2008 Wu ..... 439/557
7,445,484 B2 * 11/2008 Wu ..... 439/352
7,473,136 B2 * 1/2009 Hu et al. ..... 439/607.01
7,476,117 B1 * 1/2009 Chen et al. ..... 439/352
7,494,363 B1 * 2/2009 Wu ..... 439/352
7,549,886 B2 * 6/2009 Herring et al. ..... 439/352
7,581,978 B1 9/2009 Briant
7,651,341 B2 * 1/2010 Wu ..... 439/76.1
7,651,342 B1 * 1/2010 Wu ..... 439/76.1
7,654,831 B1 * 2/2010 Wu ..... 439/76.1
7,690,939 B2 * 4/2010 Wu ..... 439/352
7,771,225 B1 * 8/2010 Wu ..... 439/352
7,938,669 B2 * 5/2011 Li et al. ..... 439/352
8,057,260 B2 * 11/2011 Zhu et al. ..... 439/607.41
8,157,579 B2 * 4/2012 Wu ..... 439/352

(Continued)

*Primary Examiner* — Amy Cohen Johnson
*Assistant Examiner* — Vladimir Imas
(74) *Attorney, Agent, or Firm* — Wei Te Chung; Ming Chieh Chang

(57) ABSTRACT

An electrical connector assembly (100), comprises: a housing (1) having an upper shield part and a lower shield part (16) assembled with each other, and the upper shield part having at least two shield covers (15) arranged side by side along a transversal direction; a plurality of retaining pieces (9) assembled to each of two adjacent shield covers and interconnecting with the two adjacent shield covers; a plurality of printed circuit boards (2) disposed in the housing; a latch mechanism assembled to an exterior surface of the housing; and a metallic holder (8) surrounding and engaged with the housing.

20 Claims, 9 Drawing Sheets

U.S. PATENT DOCUMENTS

| | | | | |
|---|---|---|---|---|
| 8,157,580 | B2 * | 4/2012 | Wu | 439/352 |
| 8,202,122 | B2 * | 6/2012 | Wu | 439/607.47 |
| 2007/0161281 | A1 * | 7/2007 | Wu | 439/352 |
| 2008/0032541 | A1 * | 2/2008 | Reed et al. | 439/352 |
| 2012/0015545 | A1 * | 1/2012 | Wu | 439/345 |

* cited by examiner

ELECTRICAL CONNECTOR ASSEMBLY

FIELD OF THE INVENTION

The present invention generally relates to connectors suitable for transmitting data, more specifically to input/output (I/O) connectors with high-density configuration and high data transmitting rate.

DESCRIPTION OF PRIOR ART

One aspect that has been relatively constant in recent communication development is a desire to increase performance. Similarly, there has been constant desire to make things more compact (e.g., to increase density). For I/O connectors using in data communication, these desires create somewhat of a problem. Using higher frequencies (which are helpful to increase data rates) requires good electrical separation between signal terminals in a connector (so as to minimize cross-talk, for example). Making the connector smaller (e.g., making the terminal arrangement more dense), however, brings the terminals closer together and tends to decrease the electrical separation, which may lead to signal degradation.

In addition to the desire at increasing performance, there is also a desire to improve manufacturing. For example, as signaling frequencies increase, the tolerance of the locations of terminals, as well as their physical characteristics, become more important. Therefore, improvements to a connector design that would facilitate manufacturing while still providing a dense, high-performance connector would be appreciated.

Additionally, there is a desire to increase the density of I/O plug-style connectors and this is difficult to do without increasing the width of the connectors. Increasing the width of the plug connectors leads to difficulty in fitting the plug into standard width routers and/or servers, and would require a user to purchase non-standard equipment to accommodate the wider plug converters. As with any connector, it is desirable to provide a reliable latching mechanism to latch the plug connector to an external housing to maintain the mated plug and receptacle connectors together modifying the size and/or configuration the connector housing may result in a poor support for a latching mechanism. Latching mechanisms need to be supported reliably on connector housings in order to effect multiple mating cycles. Accordingly, certain individuals would appreciate a higher density connector that does not have increased width dimensions and which has a reliable latching mechanism associated therewith.

And, I/O connector will has a developing trend to form multi-ports on a front end thereof to meet more and more higher data transmitting rate requirements of the server. As a result, a width of the electrical connector becomes larger. Thus, a latch formed on the electrical connector will be difficult to operate to achieve an engagement and disengagement between the I/O connector and the complementary connector.

As discussed above, an improved electrical connector overcoming the shortages of existing technology is needed.

SUMMARY OF THE INVENTION

Accordingly, an object of the present invention is to provide an electrical connector assembly with a latch mechanism easily operated.

In order to achieve the above-mentioned objects, an electrical connector assembly, comprises: a housing having an upper shield part and a lower shield part assembled with each other, and the upper shield part having at least two shield covers arranged side by side along a transversal direction; a plurality of retaining pieces assembled to each of two adjacent shield covers and interlocking with the two adjacent shield covers; a plurality of printed circuit boards disposed in the housing; a latch mechanism assembled to an exterior surface of the housing; and a metallic holder surrounding and engaged with the housing.

Other objects, features and advantages of the invention will be apparent from the following detailed description taken in connection with the accompanying drawings.

DETAILED DESCRIPTION OF PREFERRED EMBODIMENTS

Figure 1:
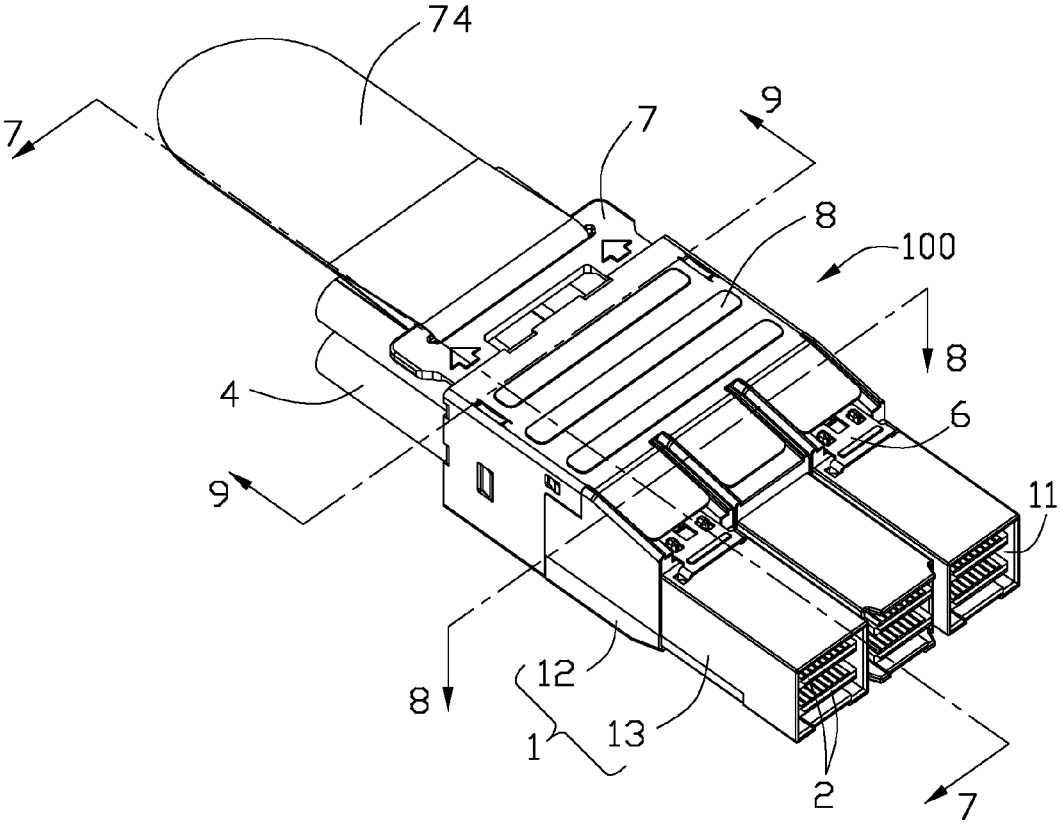
FIG. 1 is a perspective view of an electrical connector assembly in accordance with the present invention.

Reference will now be made to the drawing figures to describe the present invention in detail.

Figure 2:
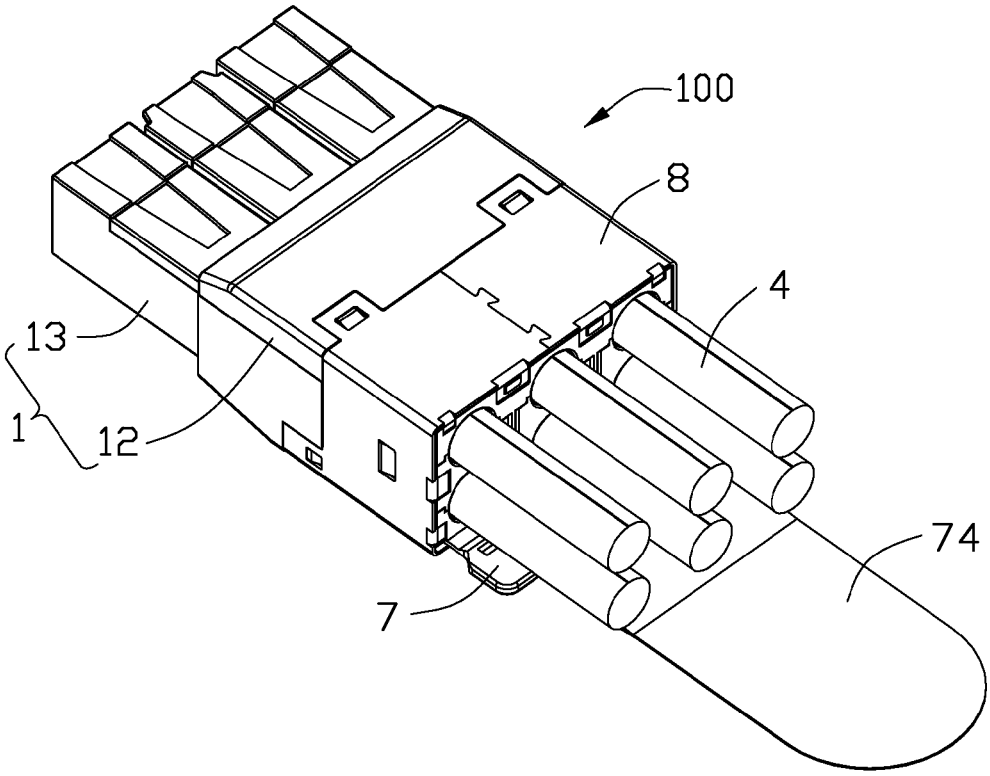
FIG. 2 is another perspective view of the electrical connector assembly of FIG. 1.

FIGS. 1 to 2 illustrate perspective views of an electrical connector assembly 100 made in accordance with the present invention. And in conjunction with FIGS. 3 to 4 and 7 to 9, the electrical connector assembly 100 comprises a housing 1 having three receiving rooms 11 formed therein, six paralleled printed circuit boards (PCBs) 2 received into three receiving rooms 11, three spacers 3 respectively disposed between two printed circuits boards 2 and engaged with the housing 1, six cables 4 respectively electrically connected with six printed circuit boards 2 and three strain reliefs 5 disposed in the housing 1 and respectively spaced apart with the two cables 4. The electrical connector assembly 100 further comprises a latch mechanism assembled to a top surface of the housing 1 and a metallic holder 8 surrounding a portion of the housing 1 and the latch mechanism. The latch mechanism comprises a latching member 6 and a pulling member 7 interconnected with each other.

Figure 3:
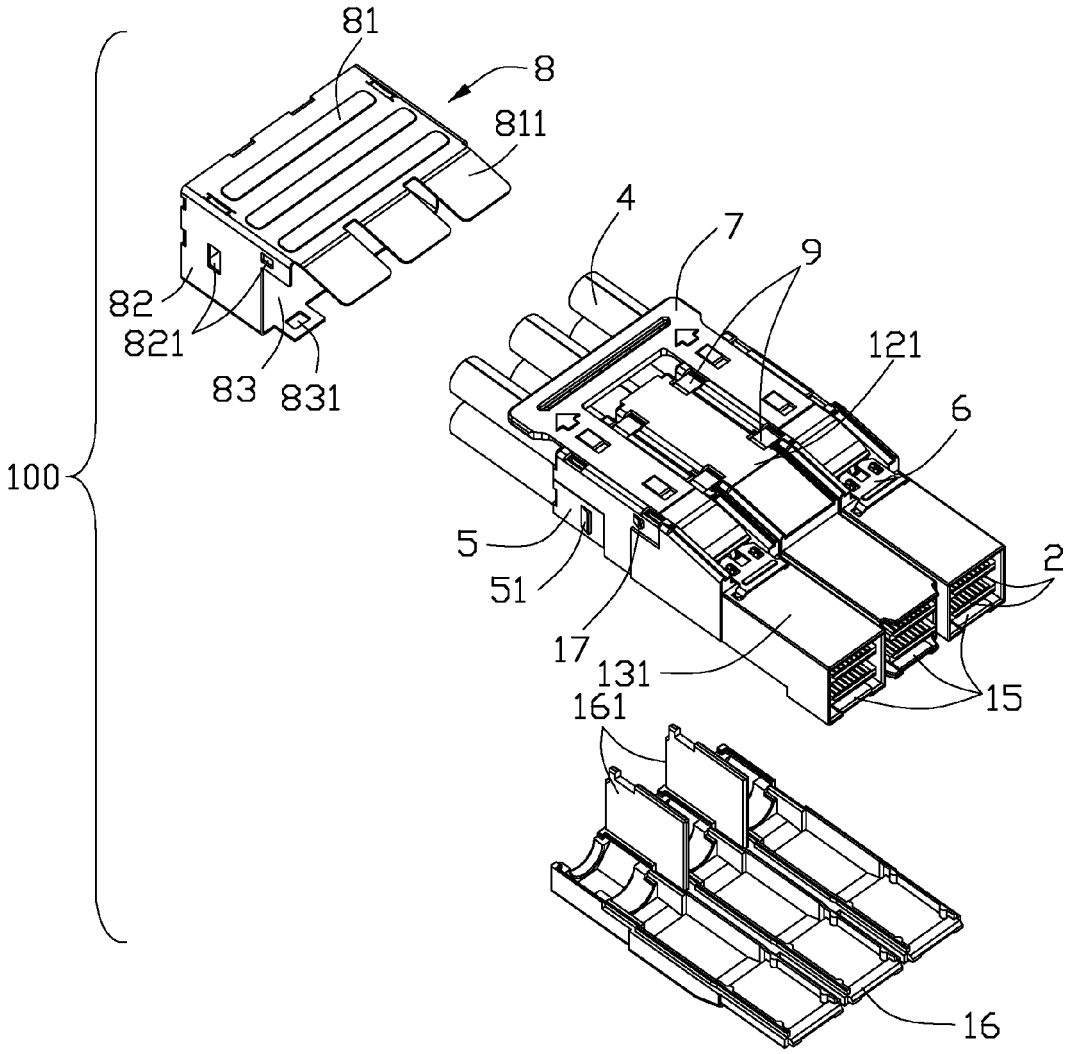
FIG. 3 is a partially assembled view of the electrical connector assembly of FIG. 1.
Figure 4:
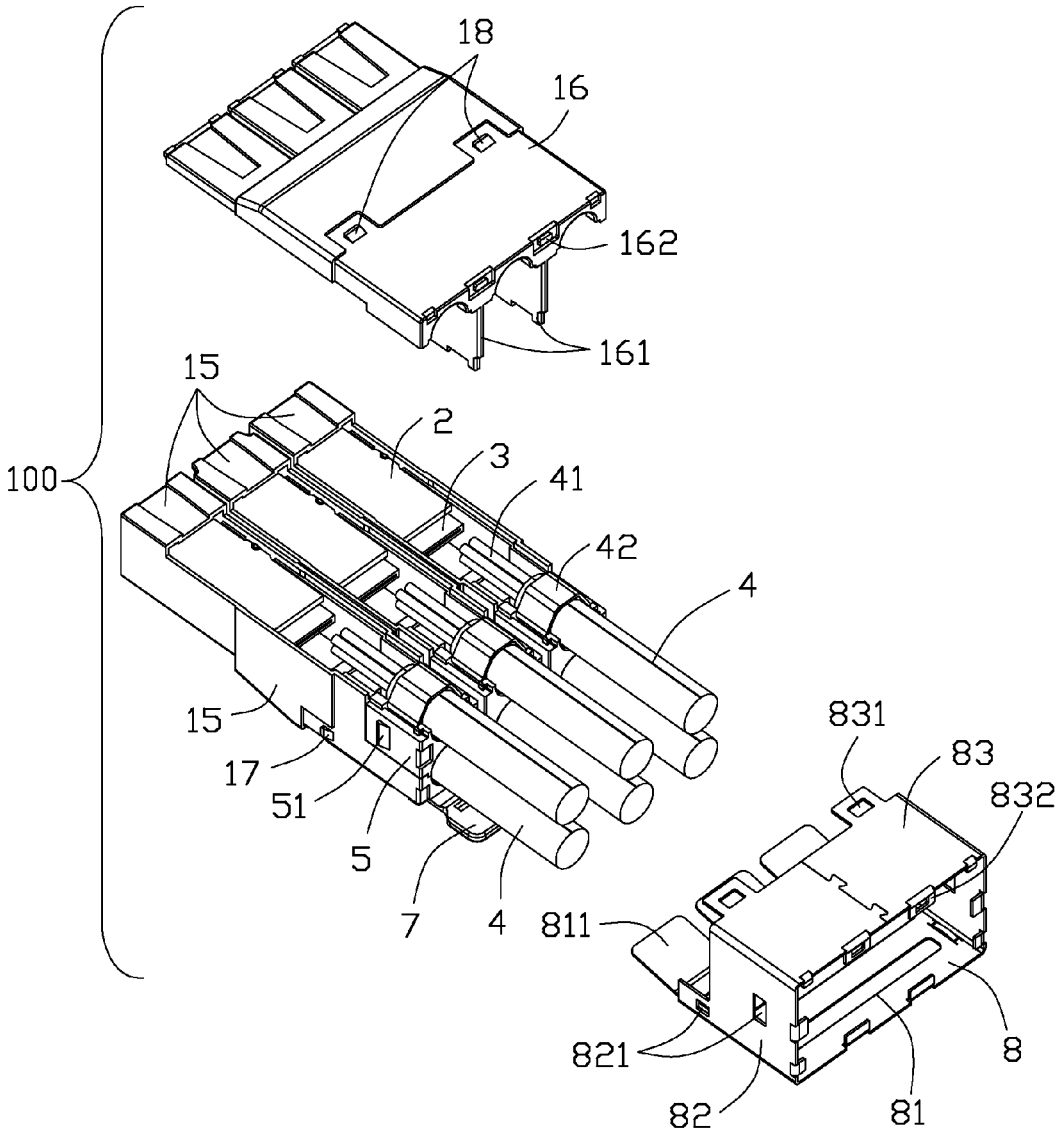
FIG. 4 is similar to FIG. 3, but viewed from another aspect.
Figure 5:
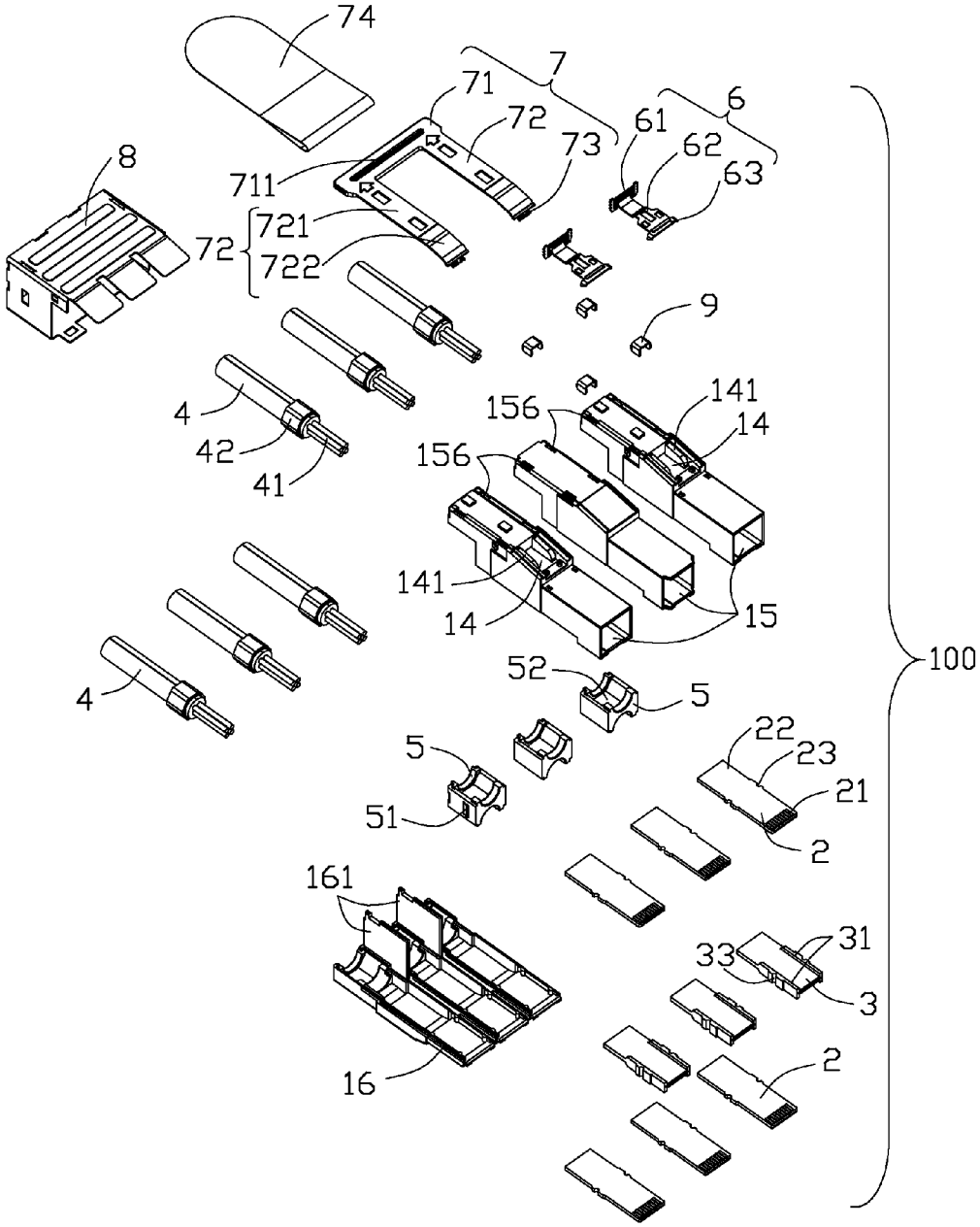
FIG. 5 is an exploded view of the electrical connector assembly of FIG. 1.

Referring to FIGS. 3 to 5, the housing 1 is made of metallic material and formed in a die-cast manner. The housing 1 defines a body portion 12 and a mating portion 13 extending forward from the body portion 12 for mating to a complementary connector (not shown). The body portion 12 has a cross section larger than that of mating portion 13. The mating portion 13 has three mating ports. The housing 1 defines three receiving rooms 11 formed therein and throughout the housing 1 along a front to rear direction. Three receiving rooms 11 are arranged side by side and spaced apart with each other. The body portion 12 of the housing 1 has a top surface defined as a first surface 121, the mating portion 13 of the housing 1 has a top surface defined as a second surface 131. The first surface 121 is disposed above the second surface 131. And, the first surface 121 defines an inclined surface 1211 toward to the second surface 131. The body portion 12 defines a pair of receiving cavities 14 extending downwardly from the inclined surface 1211 for a distance and located at two sides thereof. A pair of supporting portions 141 are formed on two inner side surfaces of each receiving cavity 14 for supporting a front curving portion 72 of the pulling member 7. Each supporting portion 143 has a front arc top surface and a rear inclined top surface. The housing 1 has a pair of wedge-shaped projections 17 respectively formed on two side surfaces thereof and a pair of wedge-shaped projections 18 formed on a bottom surface thereof for cooperating with the metallic holder 8.

Referring to FIGS. 3 to 6, the housing 1 comprises an upper shield part and a lower shield part 16 assembled with each other. And, the upper shield part comprises three shield parts 15 assembled with each other and arranged side by side. The upper shield part has three rectangular mating ports 151 defined as three mating ports of the housing 1. Each of shield part 15 is a rectangular frame and defines a cutout 152 formed on a bottom side thereof. A strain relief 5 is received into a rear end of the cutout 152. Each of shield part 15 defines a plurality of silts 156 formed on a lateral side or two lateral sides of the top surface thereof. The cable assembly 100 further comprises a plurality of retaining pieces 9. Three shield parts 15 are positioned with each other by the retaining pieces 9 to formed an upper shield part. Thus, the upper shield part can be cooperated with the lower shield part 16. And, three cutouts 152 of the upper shield part are shielded by the lower shield part 16. Each of shield part 15 defines a receiving passageway 153 extending along a front to rear direction and communicated with an exterior. The receiving passageway 153 is communicated with an exterior along a vertical direction by the cutout 152. Each of shield part 15 defines two semi-circular first positioning posts 154 formed on each of inner side surface thereof for supporting a printed circuit board 2. Two first positioning posts 154 are spaced apart with each other and arranged along a front-to-rear direction. And, each of shield part 15 defines a pair of second positioning posts 155 respectively formed between two first positioning posts 154 for limiting a front-to-rear movement of the printed circuit board 2. It should be noted that two receiving cavities 14 are respectively formed on top surface of two side shield parts 15. Two wedge-shaped projections 17 are respectively formed on outside surfaces of the two side shield parts 15. Two wedge-shaped projections 18 are formed on a bottom surface of the lower shield part 16. The lower shield part 16 defines two partitions 161 for separating three strain reliefs 5. The lower shield part 16 defines a plurality of protrusions 162 for cooperating with the metallic holder 8.

Referring to FIGS. 4 to 5, six printed circuit boards 2 are disposed in the housing 1. Each of two printed circuit boards 2 are received into a receiving room 11 of the housing 1. Each of the printed circuit board 2 has a mating section 21 formed on a front end thereof and a terminating section 22 formed on a rear end thereof. Each of the printed circuit board 2 defines a pair of slots 23 formed on two lateral sides for cooperating with the second positioning posts 155 of the shield part 15.

Figure 6:
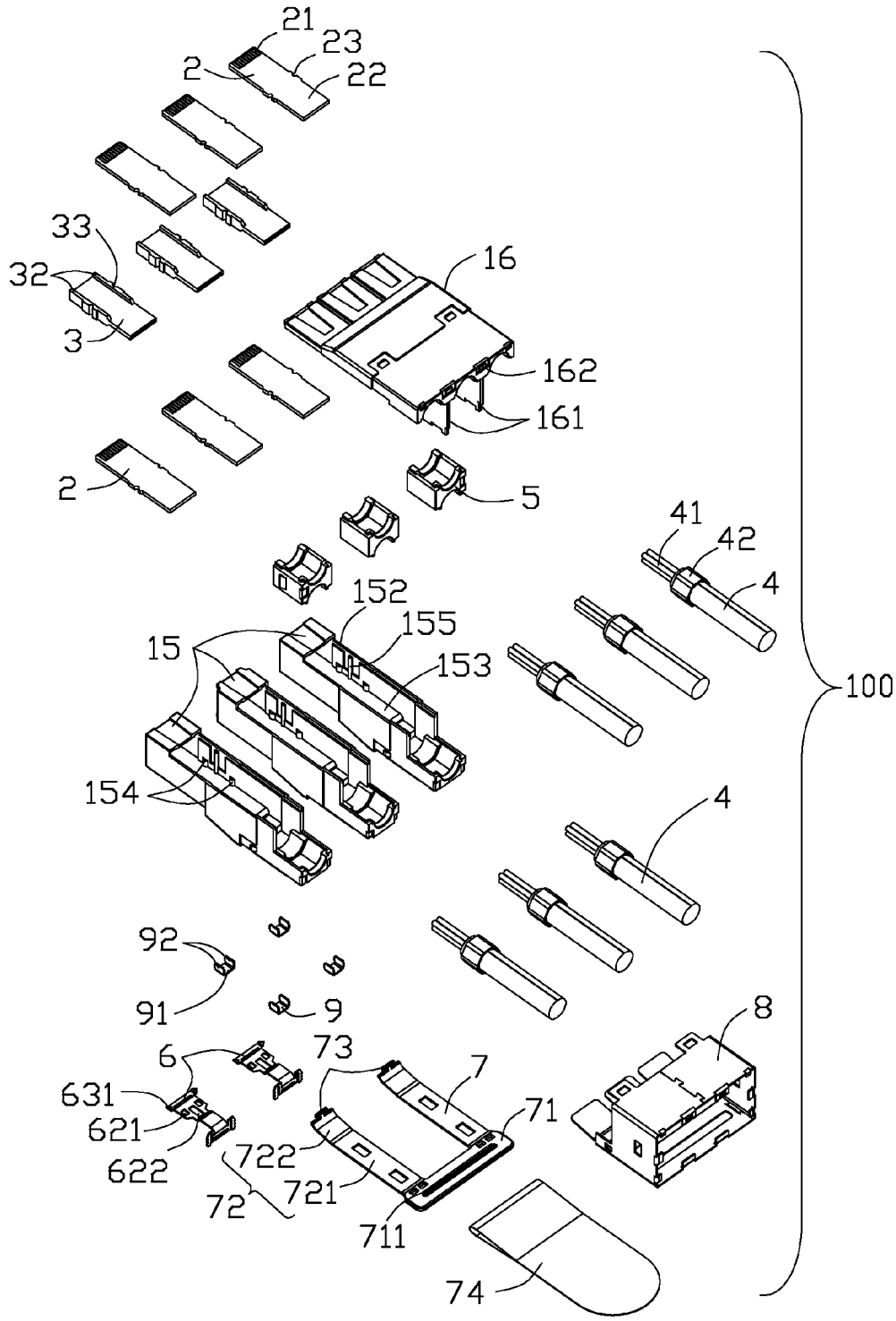
FIG. 6 is similar to FIG. 5, but viewed from another aspect.
Figure 7:
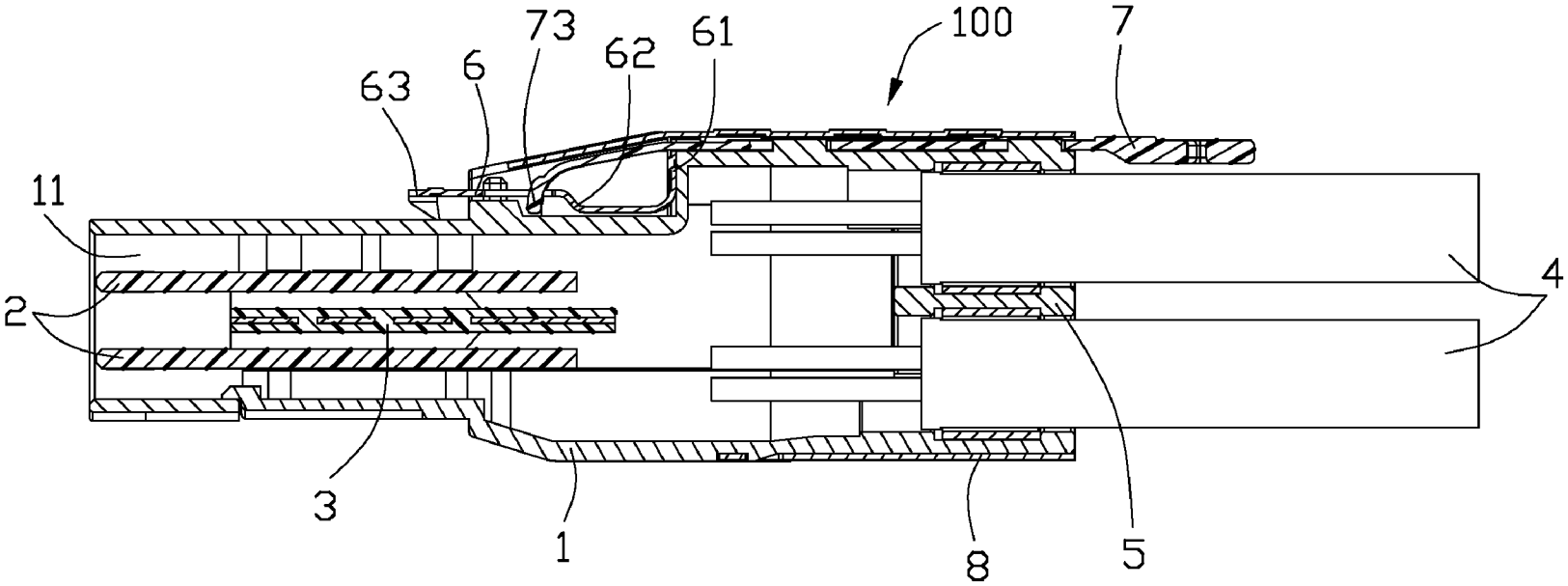
FIG. 7 is a cross section view of the electrical connector assembly of FIG. 1 taken along line 7-7.

Referring to FIGS. 5 to 6, three spacers 3 are formed of insulative material and respectively sandwiched between two printed circuit boards 2 in a vertical direction. Each of the spacer 3 defines a pair of ribs 31 formed on a top surface thereof and another pair of ribs 32 formed on a bottom surface for supporting the printed circuit boards 2. The spacer 3 further defines a pair of grooves 33 respectively formed on two sides thereof and extending along a vertical direction for cooperating with two corresponding second positioning posts 155 formed in a receiving room 11 of the shield part 15.

Referring to FIGS. 5 to 6, six cables 4 are respectively electrically and mechanically connected with six printed circuit boards 2. Each of the cable 4 has a plurality of conductors 41 formed therein and electrically connected to a terminating section 22 of the printed circuit board 2. A ring 42 is disposed at a front end of each cable 4 and surrounding a portion of the cable 4.

Figure 9:
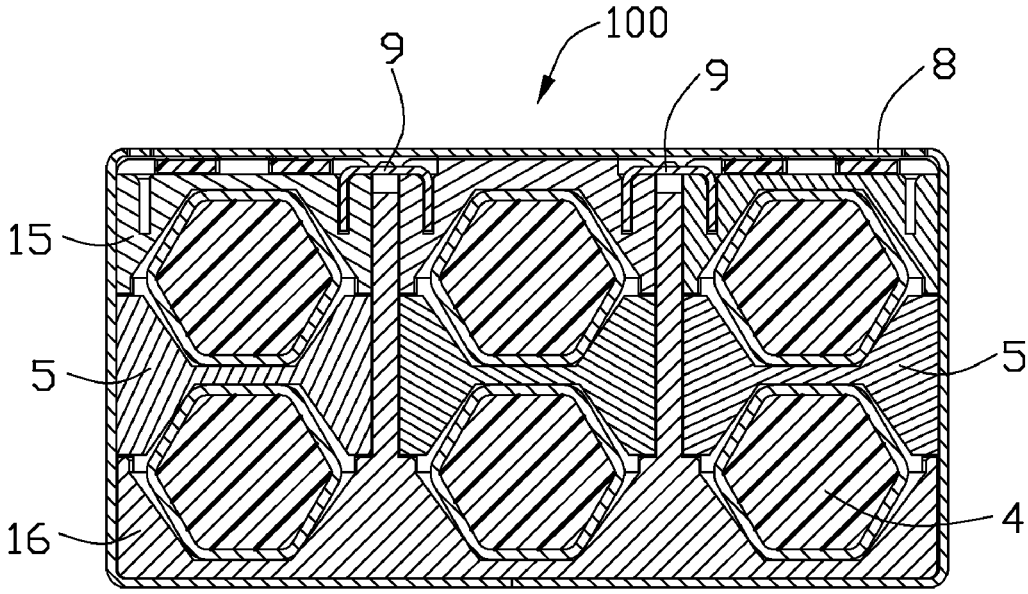
FIG. 9 is a cross section view of the electrical connector assembly of FIG. 1 taken along line 9-9.

Referring to FIGS. 5 to 6 and in conjunction with FIG. 9, three strain reliefs 5 are made of metallic material and respectively disposed in the three receiving rooms 11 of the housing 1. Each of the strain relief 5 is located on a rear area of the receiving room 11 of the housing 1 and has two recesses 52 respectively formed on a top and bottom surfaces thereof for receiving a portion of the ring 42. And, two side strain reliefs 5 respectively has a wedge-shaped projection 51 formed on an outside surface thereof.

Referring to FIGS. 3 to 5 and in conjunction with FIG. 10, two latching members 6 are stamped and formed from a metallic plate. Each of the latching member 6 comprises a vertical retaining portions 61, a connecting portion 62 extending forwardly from a bottom side of the retaining portion 61 and a latching portion 63 extending forwardly from the connecting portion 62. A front portion of the latch 6 is defined as a latching portion 63. The connecting portion 62 defines a rectangular opening 622 and two quadrate openings 621 disposed at two sides of the rectangular opening 621. The latching portion 63 defines a pair of barbs 631 formed at two sides thereof.

Referring to FIGS. 3 to 5 and in conjunction with FIG. 10, the pulling member 7 is made of insulative material and structured in a flat shape. The pulling member 7 defines an operating section 71 formed on a rear end thereof, two T-shaped actuating sections 73 formed on a front end thereof and two paralleled connecting sections 72 connecting with the operating section 71 to the two actuating sections 73. Each of the connecting section 72 defines a horizontal section 721 and a curving section 722. The operating section 71 defines a slit 711 for a pulling tap 74 passing through.

Referring to FIGS. 3 to 5 and in conjunction with FIG. 13, the metallic holder 8 defines a top wall 81, a bottom wall 83 and a pair of side walls 82 connected with the top wall 81 and the bottom wall 83. A portion of the latching member 6 and the pulling member 7 is shielded by the top wall 81. The top wall 81 defines three inclined shielding pieces 811. The top wall 81 is longer than the bottom wall 83. Each of the side wall 82 defines two holes 821 respectively cooperated with the two wedge-shaped projections 17, 51. The bottom wall 83 defines two holes 831 cooperated with the two wedge-shaped projections 18. In addition, the bottom wall 83 defines two latching sections 832 cooperated with the two projections 162 of the lower shield part 16.

Figure 8:
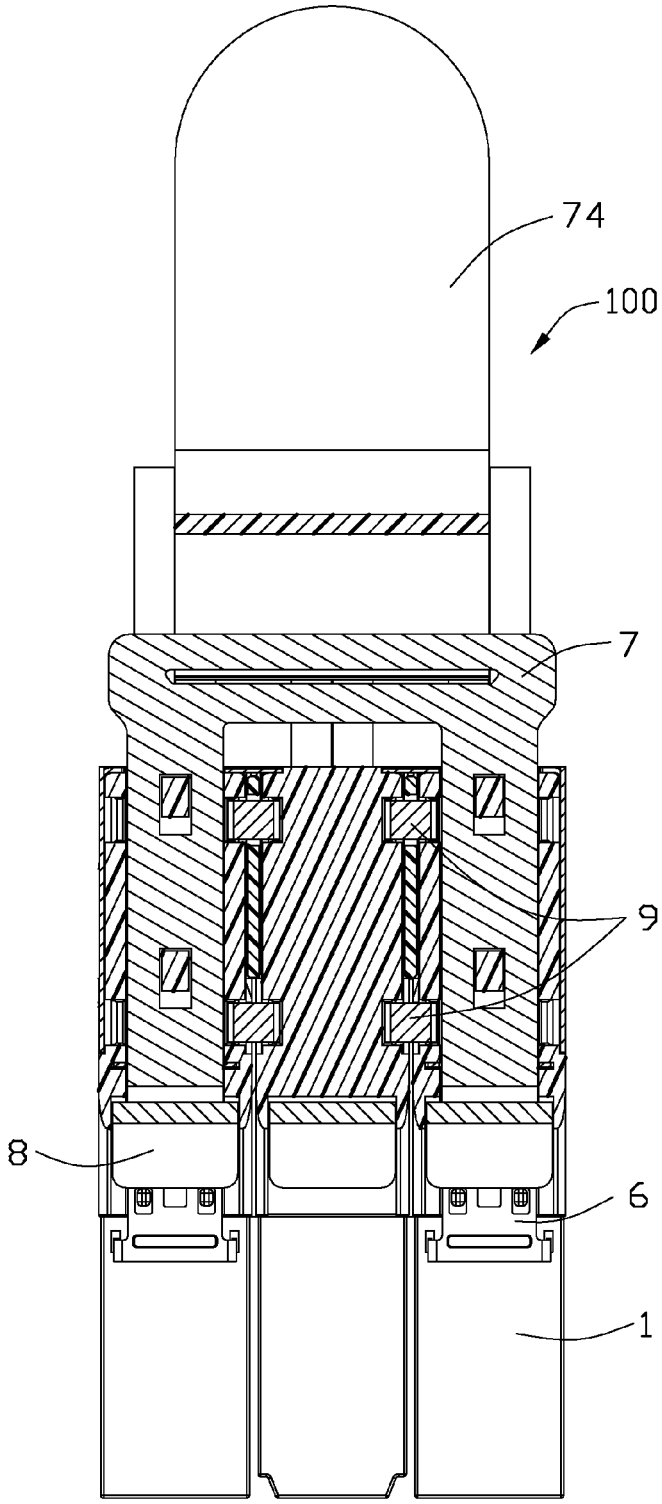
FIG. 8 is a cross section view of the electrical connector assembly of FIG. 1 taken along line 8-8.

Referring to FIGS. 3, 5 to 6 and in conjunction with FIG. 8, each of the retaining piece 9 is structured in a n-shape and has a horizontal portion 91 and two vertical portions 92 extending downwardly form two sides of the horizontal portion 91. A plurality of retaining pieces 9 are assembled to the three shield parts 15. Thus, an upper shield part is formed by three shield parts 15. Two vertical portions 91 of each retaining piece 9 are respectively inserted into a top surface of two adjacent shield part 15 along an up to down direction. The vertical portion 91 is received into a slit 156 of the shield part 15 and positioned in the slit 156. Two adjacent shield parts 15 are positioned with each other by the plurality of retaining pieces 9.

Referring to FIGS. 1 to 14, the assembling process of the electrical connector assembly 100 made in according to the present invention starts from soldering the conductors 41 of each cable 4 respectively to the terminating section 22 of each printed circuit board 2. Thus, six combination of the printed circuit board 2 and the cable 4 are formed.

Then, assembling a plurality of retaining pieces 9 to two adjacent shield parts 15. As a result, three shield parts 15 are arranged side by side and engaged with each other. The upper shield part is formed by three shield parts 15. Then, turning over the upper shield part to make the three cutouts 152 and three receiving passageways 153 facing upward. Then, assembling three combinations of the printed circuit board 2 and the cable 4 respectively into the three receiving passageways 153 through three cutouts 152. Each of the printed circuit board 2 is supported by four first positioning posts 154 of the shield part 15 along a vertical direction. And, each of the printed circuit board 2 is engaged with the shield part 15 along a front-to-rear direction due to the pair of slots 23 of the printed circuit board 2 cooperated with the pair of second positioning posts 155 of the shield part 15. And, a front end of each cable 4 is supported by a rear end of the shield part 15.

After three combinations of the cable 4 and a printed circuit board 2 are together assembled to the upper shield part, then assembling three strain reliefs 5 respectively to a rear end of the shield part 15. Each of the strain relief 5 is located to a rear end of the cutout 152 of the shield part 15. And, the ring 42 of the cable 4 is received into a room formed by the shield part 15 and the strain relief 5.

After three strain reliefs 5 are assembled to the upper shield part, then assembling three spacers 3 respectively to the three receiving passageways 153 of the three shield parts 15. Each of the spacer 3 is located upon the printed circuit board 2. The pair of second positioning posts 155 of the shield part 15 pass through the corresponding two grooves 33 of the spacer 3 along an up-to-down direction to limit a movement of the spacer 3 along a front to rear direction.

After three spacers 3 are assembled to the three shield parts 15, then assembling another three combinations of the printed circuit board 2 and the cable 4 respectively to the three receiving passageways 153 of the upper shield part and located on the three spacers 3. Each of the printed circuit board 2 is engaged with the shield part 15 along a front-to-rear direction due to the pair of slots 23 of the printed circuit board 2 cooperated with the pair of second positioning posts 155 of the shield part 15. The ring 42 of the cable 4 has a portion received into a recess 52 of the strain relief 5. Through the above assembling steps, the six printed circuit boards 2, six cables 4, three strain reliefs 5 and three spacers 3 are assembled to the upper shield part.

Then assembling the lower shield part 16 to the upper shield part. Thus, the cutouts 152 of the upper shield part are shielded by the lower shield part 16 along an up-to-down direction. The six printed circuit boards 2 are also positioned in the housing 1 by the lower shield part 16 along an up-to-down direction.

After the lower shield part 16 is assembled to the upper shield part 15, then assembling the pair of latching members 6 to the pulling member 7 through following steps. Firstly, the pair of latching members 6 are respectively disposed in front of the two actuating sections 73 of the pulling member 7 and arranged perpendicular to the two actuating sections 73 of the pulling member 7. Secondly, each of the actuating section 73 of the pulling member 7 is passed through the rectangular opening 622 of the latching member 6 and located below the latching member 6. Thirdly, each of the latching member 6 is rotated 90 degree to make the latching member 6 and the actuating section 73 of the pulling member 7 arranged in line. Thus, the pair of latching members 6 are interconnected with the pulling member 7. And, the pair of latching members 6 are not easily discrete from the pulling member 7 due to the width of the actuating section 73 is wider than a width of the rectangular opening 622.

Then, assembling the pair of latching members 6 and the pulling member 7 together to an exterior surface of housing 1. The two connecting sections 72 of the pulling member 7 are located on the first surface 121 of the body portion 12 of the housing 1. The curving section 722 of each connecting section 72 is supported by the supporting portions 141 formed in the receiving cavity 14. The operating section 71 of the pulling member 7 extends rearwardly beyond the rear surface of the housing 1. In addition, each of the latching member 6 is received into the receiving cavity 14. Thus, the retaining portion 61 of the latching member 6 is respectively disposed in a rear end of the receiving cavity 14 to make the latching member 6 engaged with the housing 1. The connecting portion 62 of the latching member 6 is located above the bottom surface 141 of the receiving cavity 14. The latching portion 63 extends forwardly and is located above the second surface 131 of the mating portion 13 of the housing 1. The latching portion 63 is cantilevered from the retaining portion 61. A tape 74 is passed through the slit 711 and connected to the pulling member 7. When a rearward pulling force is exerted on a rear end of the pulling member 7 or the tape 74, the latching portion 63 of the latching member 6 will be raised up. When the rearward pulling force is released, the latching portion 63 of the latching member 6 will resume to an original state.

Finally, assembling a metallic holder 8 to a body portion 12 of the housing 1 to bind the upper shield part, three strain reliefs 5 and the lower shield part 16 together. The pulling member 7 can be moved along a front to rear direction relative to the housing 1 and limited by the metallic holder 8 along a vertical direction. A portion of the latch mechanism is shielded by the metallic holder 8. Two holes 821 of each side wall 82 of the metallic holder 8 are respectively cooperated with the two wedge-shaped projections 17, 51 of the body portion 12 and the strain relief 5. Two holes 831 of the bottom wall 83 are cooperated with the two wedge-shaped projections 18. And two latching sections 832 of the bottom wall 83 are cooperated with the two projections 162 of the lower shield part 16. Thus, the metallic holder 8 is firmly engaged with the housing 1.

After the above assembling steps, the entire process of assembling of the electrical connector assembly 100 is finished. The electrical connector assembly 100 has a new mating surface to meet higher and higher data transmitting rate. On another aspect, a reliable latch mechanism is provided to an exterior surface of the housing. And, an easily and conveniently operating manner between the latching member 6 and the pulling member 7 is achieved.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly, comprising:

a housing having an upper shield part and a lower shield part assembled with each other, and the upper shield part having at least two shield covers arranged side by side along a transversal direction;

a plurality of retaining pieces assembled to each of two adjacent shield covers and interlocking with the two adjacent shield covers;

a plurality of printed circuit boards disposed in the housing;

a latch mechanism assembled to an exterior surface of the housing; and a metallic holder surrounding and engaged with the housing.

2. The electrical connector assembly as recited in claim 1, wherein each of the retaining piece is structured in a n-shape.

3. The electrical connector assembly as recited in claim 2, wherein the retaining piece has a horizontal section and two vertical sections extending downwardly from two sides of the horizontal section and respectively inserted into the two shield covers.

4. The electrical connector assembly as recited in claim 1, wherein the electrical connector assembly further comprises a plurality of cables respectively electrically connected to the corresponding printed circuit boards.

5. The electrical connector assembly as recited in claim 1, wherein the latch mechanism has a portion is shielded by the metallic holder.

6. The electrical connector assembly as recited in claim 5, wherein the latch mechanism comprises a pair of latching members and a pulling member interconnected with the pair of latching members.

7. The electrical connector assembly as recited in claim 6, wherein the pulling member has two front actuating sections extending downwardly and respectively passing through the two latching members and located below the pair of latching members.

8. The electrical connector assembly as recited in claim 7, wherein the latching member is operated in a lever manner when the pulling member is moveable in a horizontal direction.

9. An electrical connector assembly, comprising:

a housing defining a plurality mating ports formed at a front end thereof, the housing having a first shield part and a second shield part assembled with each other along a vertical direction, the first shield part defining a plurality of shield covers arranged along a transversal direction;

a plurality of retaining pieces inserted into the first shield part along a vertical direction to interlock the plurality of shield covers together;

a plurality of conductive contacts disposed in the mating ports;

a pair of latching members assembled to an exterior surface of the housing;

a pulling member having two actuating sections interconnected with the pair of latching members; and a metallic holder binding the first shield part and the second shield part together, and the metallic holder engaged with the housing.

10. The electrical connector assembly as recited in claim 9, wherein each of the retaining piece is in a n-shape, two vertical portions of the retaining piece are respectively inserted into two adjacent shield covers.

11. The electrical connector assembly as recited in claim 9, wherein the electrical connector assembly further comprises a plurality of strain reliefs sandwiched by the first shield part and the second shield part and engaged with the metallic holder.

12. The electrical connector assembly as recited in claim 9, wherein each of the mating port is formed in a front end of the shield cover.

13. The electrical connector assembly as recited in claim 9, wherein the pulling member further has an operating section and two connecting sections respectively connecting the two actuating sections to the operating section.

14. The electrical connector assembly as recited in claim 9, wherein the metallic holder defines top wall and a plurality of inclined shielding pieces extending forwardly and downwardly from the top wall for shielding a portion of the pair of latching members and the pulling member.

15. An electrical connector assembly comprising:

a housing including an upper shield part and a lower shield part under condition that the upper shield part includes a plurality of shield covers side by side interlocked with one another in an intimate manner along a transverse direction while the lower shield part is unitary and spans with a dimension similar to a sum of said shield covers in said transverse direction;

each of said shield covers defining a rectangular frame with a mating port therein to communicate with an exterior in a front-to-back direction perpendicular to said transverse direction;

a latch mechanism assembled upon an exterior face of the housing with corresponding latch members moveable in a vertical direction perpendicular to both said transverse direction and said front-to-back direction;

a metallic holder assembled unto the housing and enclosing both the upper shield part and the lower shield part.

16. The electrical connector assembly as claimed in claim 15, wherein interlocking between every adjacent two shield covers is made via a retaining piece simultaneously assembled to said adjacent two respective shield covers.

17. The electrical connector assembly as claimed in claim 15, wherein the lower shield part defines a plurality of partitions each sandwiched between the corresponding two shield covers in the transverse direction.

18. The electrical connector assembly as claimed in claim 15, wherein each of the shield covers of the upper shield part cooperates with the lower shield part to receive two cables under condition that said two cables are engaged by the upper shield part and the lower shield part on upper and lower sides thereof, and commonly sandwich a strain relief therebetween.

19. The electrical connector assembly as claimed in claim 15, wherein an amount of the latch members is less than that of the shield covers.

20. The electrical connector assembly as claimed in claim 15, wherein each mating port receives a pair of printed circuit boards with a spacer sandwiched therebetween in said vertical direction.

* * * * *